US011450493B2

(12) United States Patent
Chen et al.

(10) Patent No.: US 11,450,493 B2
(45) Date of Patent: Sep. 20, 2022

(54) KEY ASSEMBLY AND KEYBOARD MODULE

(71) Applicant: Lite-On Technology Corporation, Taipei (TW)

(72) Inventors: Chun-Lin Chen, Taipei (TW); Jui-Yu Wu, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 17/306,950

(22) Filed: May 4, 2021

(65) Prior Publication Data

US 2022/0076906 A1 Mar. 10, 2022

Related U.S. Application Data

(60) Provisional application No. 63/074,920, filed on Sep. 4, 2020.

(30) Foreign Application Priority Data

Oct. 27, 2020 (CN) ..... 202011163352.0

(51) Int. Cl.
*H01H 13/705* (2006.01)

(52) U.S. Cl.
CPC ..... *H01H 13/705* (2013.01)

(58) Field of Classification Search
CPC ..... H01H 13/705; H01H 13/14; H01H 2233/034; H01H 2233/07; H01H 13/7065;

(Continued)

(56) References Cited

U.S. PATENT DOCUMENTS 9,373,454 B2 * 6/2016 Takemae ..... H01H 3/125
9,437,378 B2 * 9/2016 Nishino ..... H01H 3/125

(Continued)

FOREIGN PATENT DOCUMENTS

CN 202940152 5/2013
CN 103426672 12/2013

(Continued)

OTHER PUBLICATIONS

"Office Action of China Counterpart Application", dated Jan. 13, 2022, p. 1-p. 8.

(Continued)

*Primary Examiner* — Lheiren Mae A Caroc
(74) *Attorney, Agent, or Firm* — JCIPRNET

(57) ABSTRACT

A key assembly includes a bottom plate, a keycap disposed on the bottom plate, an elastic member disposed between the bottom plate and the keycap, a link member, and a protruding member. The keycap has an inner surface facing the bottom plate and includes a link member pivoting portion protruding from the inner surface. The link member pivoting portion has a pivot hole and an opening communicating with the pivot hole and away from the inner surface. A size of the opening is smaller than a size of the pivot hole. The link member is rotatably disposed in the pivot hole. The protruding member is disposed between the inner surface of the keycap and the link member. The link member is supported by the protruding member and contacts a part of the link member pivoting portion near the opening on a wall surface surrounding the pivot hole.

10 Claims, 13 Drawing Sheets

(58) Field of Classification Search
CPC ..... H01H 3/125; H01H 3/122; H01H 13/85; H01H 13/70; H01H 3/12; H01H 2221/062
See application file for complete search history.

(56) References Cited

U.S. PATENT DOCUMENTS

| | | | | |
|---|---|---|---|---|
| 2014/0367240 | A1* | 12/2014 | Lin | H01H 3/125 200/344 |
| 2016/0148763 | A1 | 5/2016 | Chen | |
| 2019/0096604 | A1 | 3/2019 | Yen | |

FOREIGN PATENT DOCUMENTS

| | | |
|---|---|---|
| CN | 109559924 | 4/2019 |
| CN | 110352468 | 10/2019 |
| CN | 110797223 | 2/2020 |
| CN | 211319988 | 8/2020 |
| JP | H10171569 | 6/1998 |
| JP | 2014216262 | 11/2014 |
| TW | 201614701 | 4/2016 |
| TW | I653547 | 3/2019 |
| TW | I669734 | 8/2019 |

OTHER PUBLICATIONS

"Notice of allowance of China Counterpart Application", dated Jun. 24, 2022, p. 1-p. 4.

* cited by examiner

KEY ASSEMBLY AND KEYBOARD MODULE

CROSS-REFERENCE TO RELATED APPLICATION

This application claims the priority benefit of U.S. provisional application Ser. No. 63/074,920, filed on Sep. 4, 2020, and China application serial no. 202011163352.0, filed on Oct. 27, 2020. The entirety of each of the above-mentioned patent applications is hereby incorporated by reference herein and made a part of this specification.

BACKGROUND

Technical Field

The disclosure relates to a key assembly and a keyboard module, in particular to a key assembly that is unlikely to generate noise and a keyboard module having the key assembly.

Description of Related Art

A keyboard is a fairly common input device. In the keyboard, link members are usually disposed in multiple-width key assemblies to ensure that even if a user presses only corners of a keycap instead of a center of the keycap, the entire keycap still moves up and down relative to a bottom plate through the link member. However, when the keycap moves up and down, the link member usually collides with the keycap and generates noise. Or when the notebook computer is playing sound, the link member may vibrate with vibrations of low-frequency sounds, and then the link member collides with the keycap and generates the noise.

SUMMARY

The disclosure is directed to a key assembly which may reduce a probability of generating noise when a link member is pressed down.

The disclosure is directed to a keyboard module including the above-mentioned key assembly.

According to an embodiment of the disclosure, a key assembly includes a bottom plate, a keycap, an elastic member, a link member, and a protruding member. The keycap is disposed on the bottom plate. The keycap has an inner surface facing the bottom plate, and the keycap includes a link member pivoting portion protruding from the inner surface. The link member pivoting portion has a pivot hole and an opening communicating with the pivot hole and away from the inner surface, and a size of the opening is smaller than a size of the pivot hole. The elastic member is disposed between the bottom plate and the keycap. The link member is rotatably disposed in the pivot hole. The protruding member is disposed between the inner surface of the keycap and the link member. The link member is supported by the protruding member and contacts a part of the link member pivoting portion near the opening on a wall surface surrounding the pivot hole.

In an embodiment according to the disclosure, the protruding member is disposed on the inner surface of the keycap.

In an embodiment according to the disclosure, the protruding member is integrated with the keycap.

In an embodiment according to the disclosure, a height difference between a top surface of the protruding member and a bottom of the link member pivoting portion on the wall surface surrounding the pivot hole is between 0.02 mm and 0.04 mm.

In an embodiment according to the disclosure, the protruding member is protrudingly disposed on the wall surface of the link member pivoting portion surrounding the pivot hole, and the protruding member corresponds to the opening.

In an embodiment according to the disclosure, a top surface of the protruding member is a flat surface, an arc surface, or a tapered surface.

In an embodiment according to the disclosure, the link member pivoting portion is divided into a first section and a second section in an axial direction of the pivot hole. The pivot hole and the protruding member are located in the first section, and the second section has a hole corresponding to the pivot hole. A size of the hole is larger than the size of the pivot hole. The link member does not contact a wall surface of the link member pivoting portion surrounding the hole.

In an embodiment according to the disclosure, a thickness of the second section is smaller than a thickness of the first section.

In an embodiment according to the disclosure, the keycap includes a plate body portion and a side wall protruding from a periphery of the plate body portion. The plate body portion has an inner surface. The link member pivoting portion includes a first hook portion and a second hook portion, and the first hook portion and the second hook portion jointly form the pivot hole and the opening. The first hook portion protrudes from the inner surface of the keycap, and the second hook portion extends inward from the side wall of the keycap and protrudes from the inner surface of the keycap. A height of the first hook portion and the second hook portion protruding from the inner surface of the keycap is greater than a height of the side wall protruding from the inner surface of the keycap.

According to an embodiment of the disclosure, a keyboard module includes the above-mentioned key assembly.

In summary, the link member of the key assembly of the disclosure is rotatably disposed in the pivot hole of the link member pivoting portion of the keycap, and the protruding member is disposed between the inner surface of the keycap and the link member. Since the protruding member protrudes from the inner surface of the keycap, the link member is supported by the protruding member, and contacts the part of the link member pivoting portion near the opening on the wall surface surrounding the pivot hole. In other words, the protruding member may compensate or reduce a size difference between the pivot hole of the link member pivoting portion of the keycap and the link member, so that the link member may be stably supported. Therefore, when the keycap is pressed down or the low-frequency sounds vibrate, a probability that the link member swings in the pivot hole of the link member pivoting portion of the keycap and generates the noise may be reduced.

DETAILED DESCRIPTION OF DISCLOSED EMBODIMENTS

Figure 1:
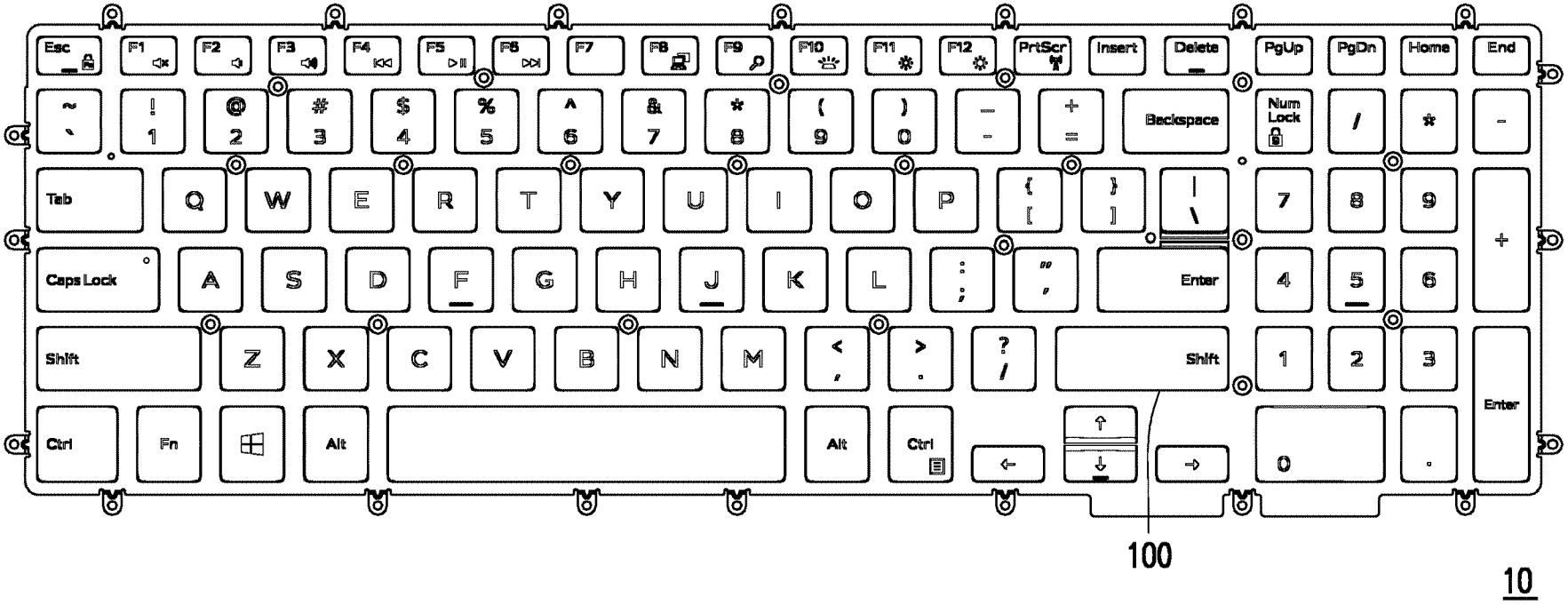
FIG. 1 is a schematic top view of a keyboard module according to an embodiment of the disclosure.

Hereinafter, exemplary embodiments of the disclosure will be described in detail, and examples of the exemplary embodiments are illustrated in accompanying drawings. Whenever possible, the same reference numerals are used in the drawings and descriptions to indicate the same or similar parts.

FIG. 1 is a schematic top view of a keyboard module according to an embodiment of the disclosure. Please refer to FIG. 1; a keyboard module 10 of the embodiment includes a key assembly 100. The key assembly 100 is, for example, a multiple-width key which is longer than a normal key such as a space key or a function key, but the type of the key assembly 100 is not limited thereto. The key assembly 100 of the embodiment is less likely to collide with a keycap 120 (FIG. 2) or resonate to generate noise when the key assembly 100 is pressed down or when low-frequency sounds are played, which is illustrated below.

Figure 2:
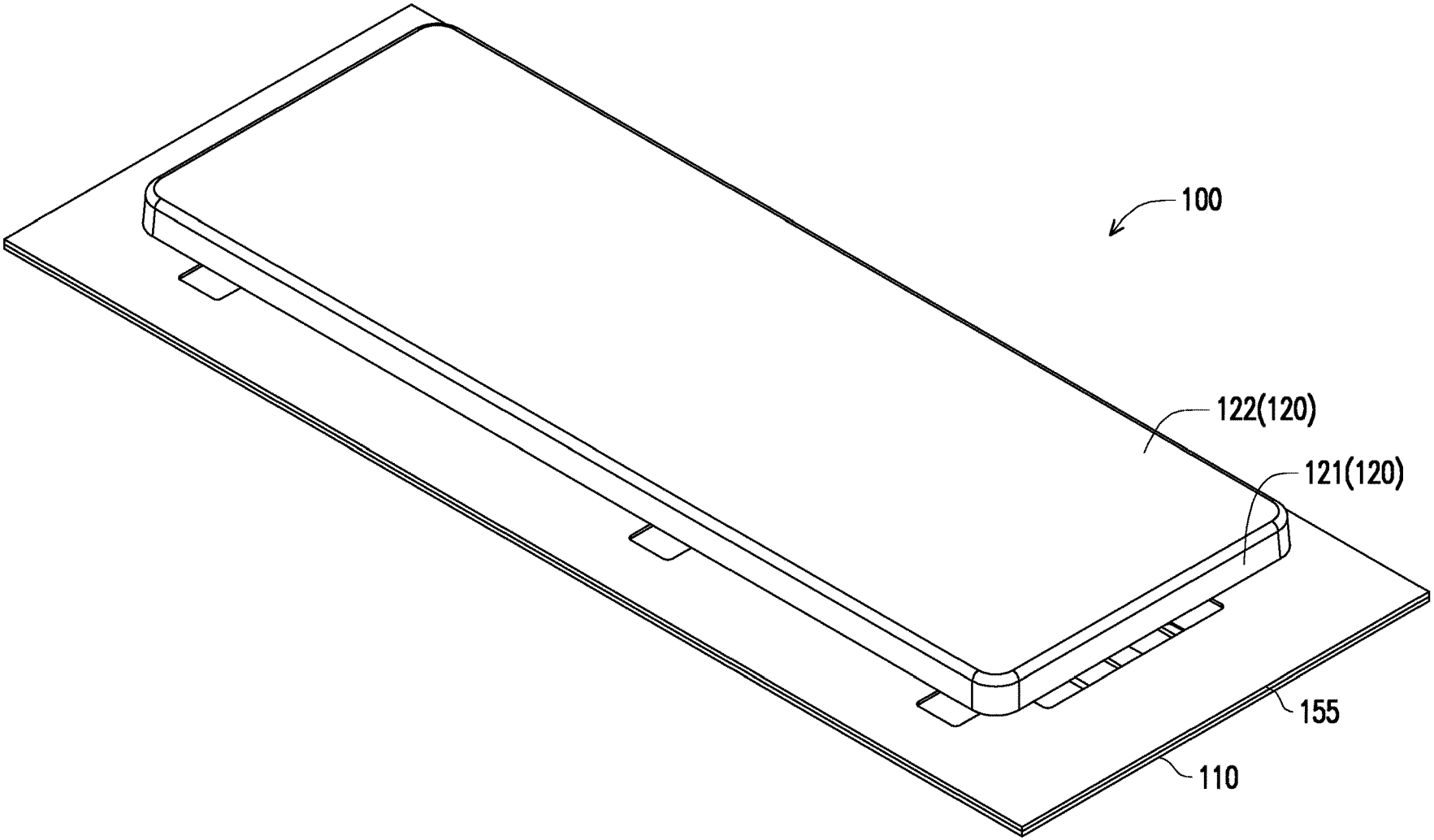
FIG. 2 is a schematic perspective view of a key assembly according to an embodiment of the disclosure.
Figure 3:
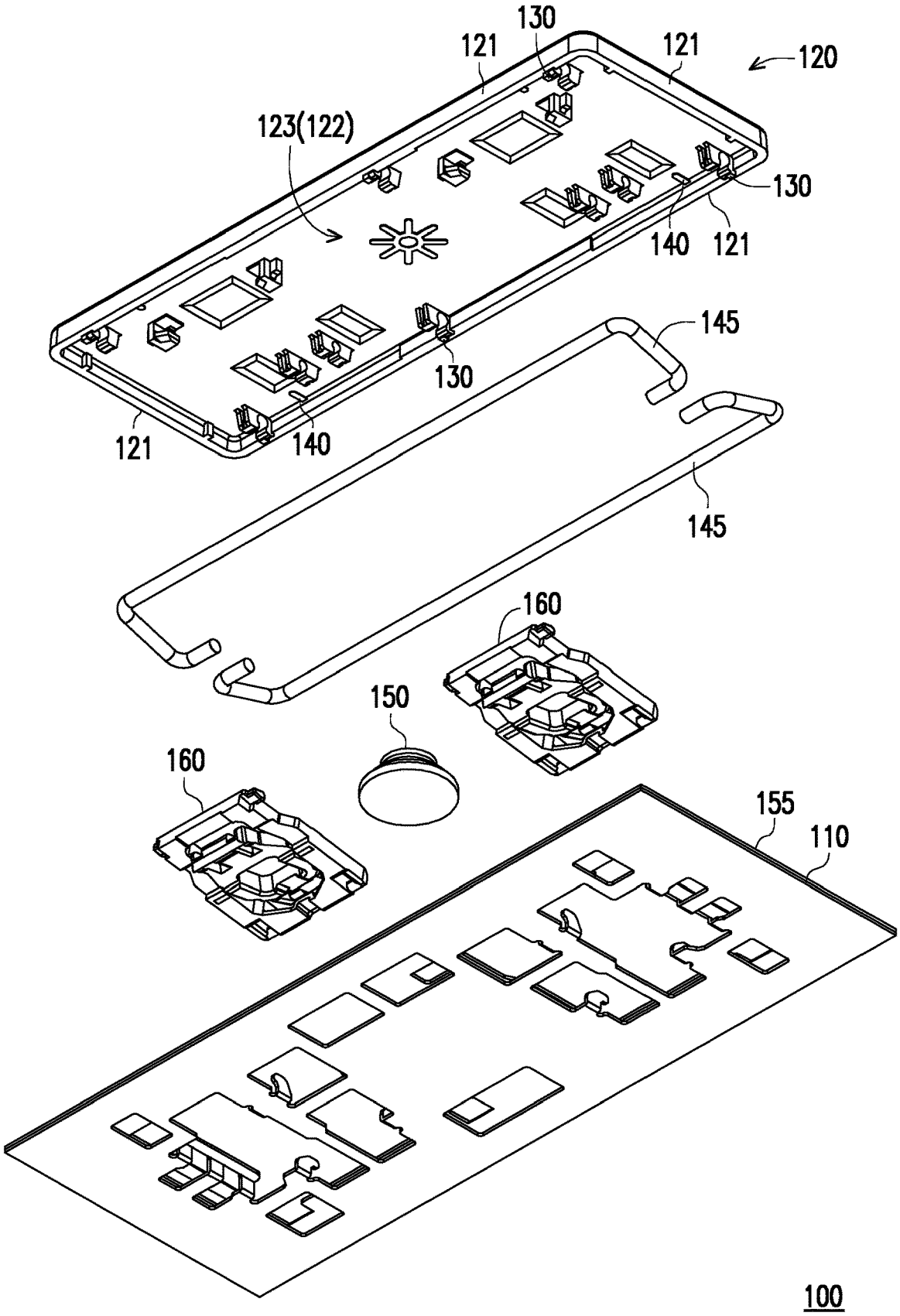
FIG. 3 is a schematic exploded view of FIG. 2.
Figure 4:
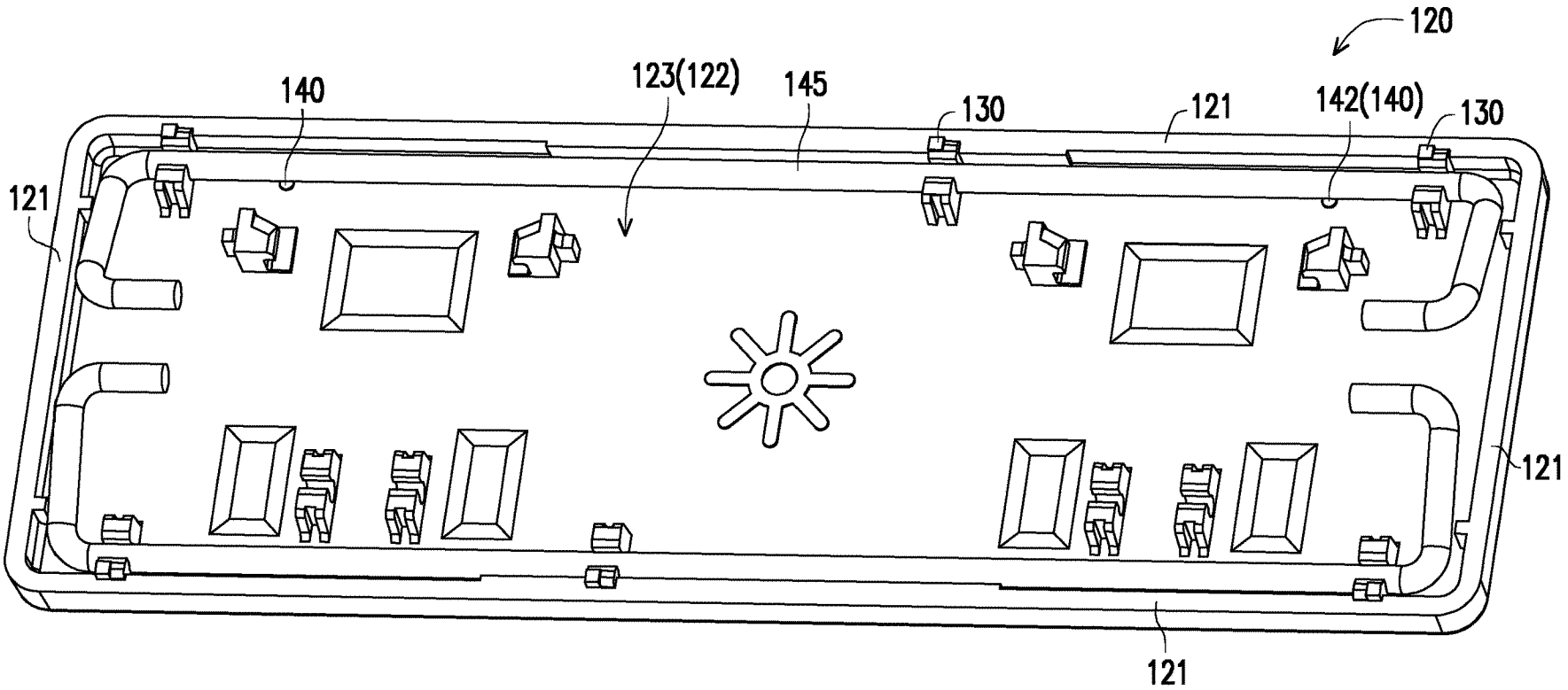
FIG. 4 is a schematic perspective view of a keycap and a link member of the key assembly of FIG. 2.
Figure 5:
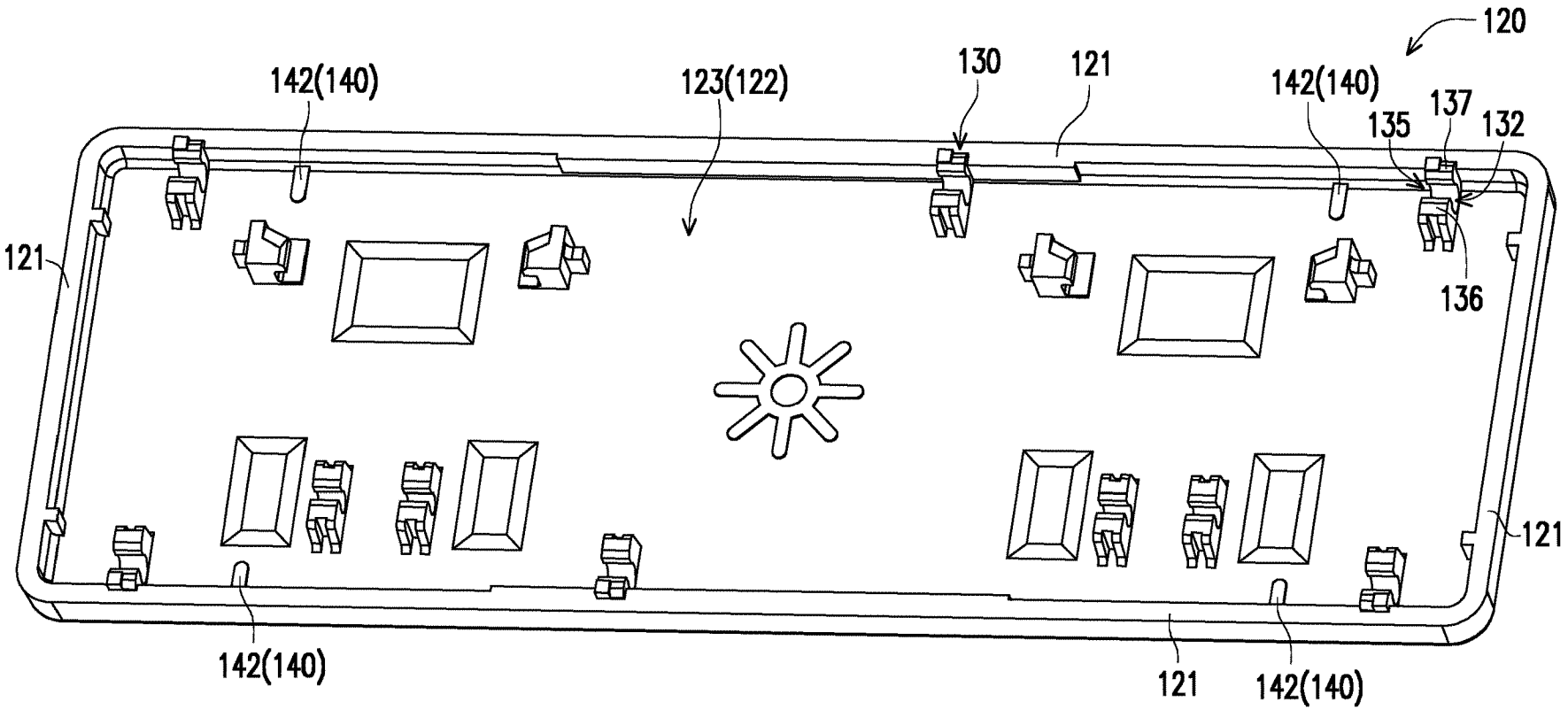
FIG. 5 is a schematic perspective view of the keycap of the key assembly of FIG. 2.
Figure 6:
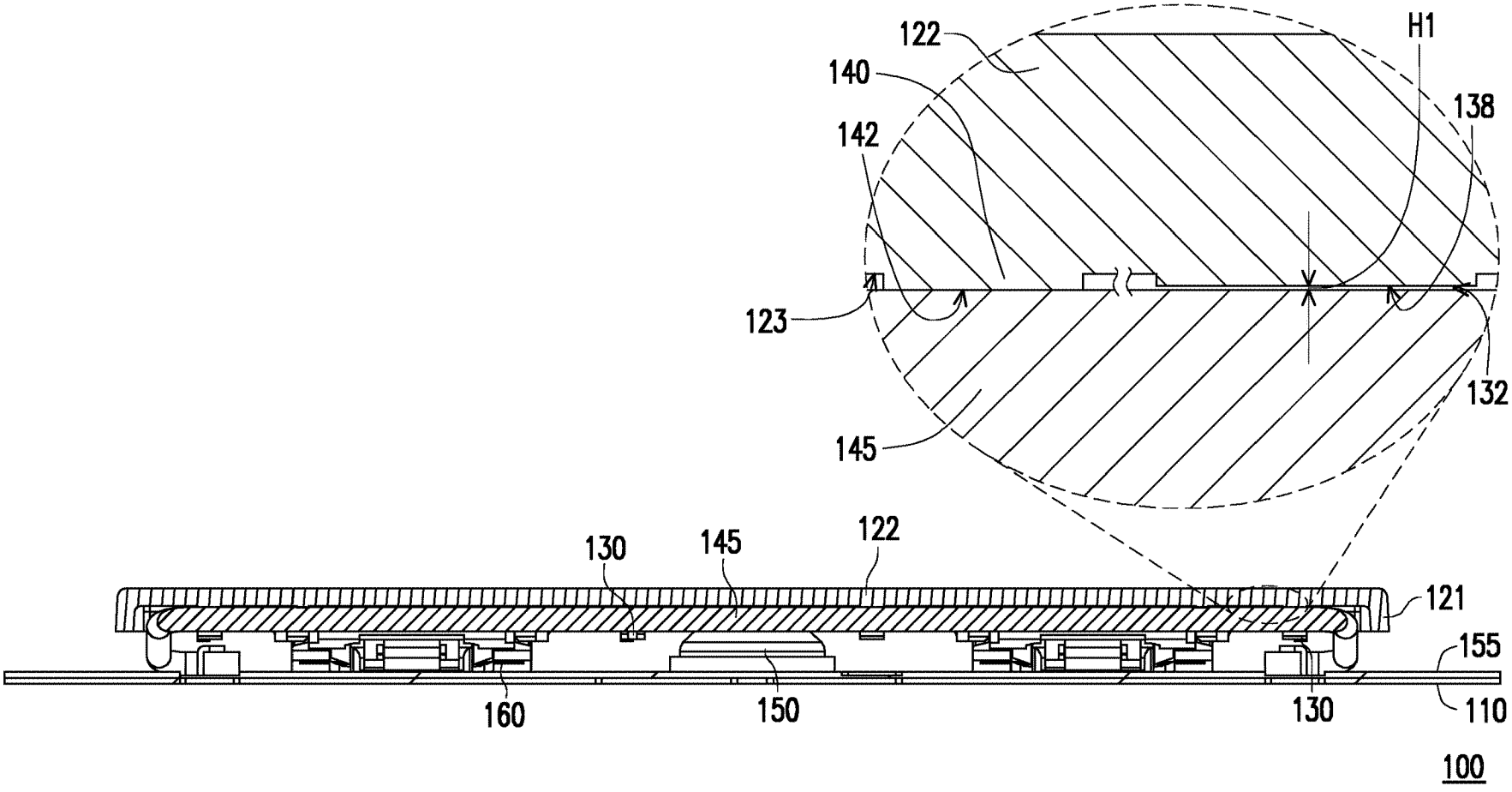
FIG. 6 is a schematic cross-sectional view of FIG. 2.

FIG. 2 is a schematic perspective view of a key assembly according to an embodiment of the disclosure. FIG. 3 is a schematic exploded view of FIG. 2. FIG. 4 is a schematic perspective view of a keycap and a link member of the key assembly of FIG. 2. FIG. 5 is a schematic perspective view of the keycap of the key assembly of FIG. 2. FIG. 6 is a schematic cross-sectional view of FIG. 2.

Please refer to FIGS. 2 to 6; in the embodiment, the key assembly 100 includes a bottom plate 110, a circuit film 155, a keycap 120, an elastic member 150 (FIG. 3), a link member 145 (FIG. 3), a support structure 160 (FIG. 3), and a protruding member 140 (FIG. 3). The circuit film 155 is disposed on the bottom plate 110. The circuit film 155 is, for example, a flexible film circuit with a multilayer stack structure. The circuit film 155 has a conductive portion (not shown) as a switch region to trigger signals. The keycap 120 is disposed on the bottom plate 110.

The elastic member 150 is disposed between the bottom plate 110 and the keycap 120, providing a restoring force for the keycap 120 to reset to a position before being pressed. The elastic member 150 is located on the circuit film 155 corresponding to the conductive portion of the circuit film 155. When the keycap 120 is pressed, the elastic member 150 is squeezed and deforms. The elastic member 150 then moves downward and presses the conductive portion on the circuit film 155, so that the switch is turned on to generate a pressing signal. When a force of pressing the keycap 120 is removed, an elastic restoring force of the elastic member 150 drives the keycap 120 upward to return to the original position.

The supporting structure 160 is disposed between the keycap 120 and the bottom plate 110. Two ends of the supporting structure 160 are respectively movably connected to the keycap 120 and the bottom plate 110, so that the keycap 120 moves smoothly up and down relative to the bottom plate 110 through a connection of the supporting structure 160. The supporting structure 160 is, for example, a scissor structure, but the disclosure is not limited thereto.

As shown in FIG. 5, the keycap 120 includes a plate body portion 122 and a side wall 121 protruding from a periphery of the plate body portion 122. In the embodiment, the plate body portion 122 is rectangular, and the number of the side wall 121 is, for example, four. The form of the keycap 120 is not limited thereto. The plate body portion 122 has an inner surface 123 facing the bottom plate 110, and the keycap 120 includes a link member pivoting portion 130 protruding from the inner surface 123. In the embodiment, the number of the link member pivoting portion 130 is six, and every three link member pivoting portions 130 jointly carry one link member 145. The relationship between the number of the link member pivoting portion 130 and the link member 145 is not limited thereto.

Each of the link member pivoting portions 130 has a pivot hole 132 and an opening 135 communicating with the pivot hole 132 and away from the inner surface 123. The link member pivoting portion 130 includes a first hook portion 136 and a second hook portion 137, and the first hook portion 136 and the second hook 137 jointly form the pivot hole 132 and the opening 135. A size of the opening 135 is smaller than a size of the pivot hole 132. Specifically, an outer diameter of the link member 145 is larger than an inner diameter of the opening 135 of the link member pivoting portion 130, and the outer diameter of the link member 145 is smaller than an inner diameter of the pivot hole 132.

As shown in FIG. 4, the link member 145 is rotatably disposed in the pivot hole 132. In the embodiment, the first hook portion 136 and the second hook portion 137 are plastic and slightly flexible. When the link member 145 is assembled, an assembler is able to apply a force to squeeze the link member 145 through the opening 135 between the first hook portion 136 and the second hook portion 137. After the link member 145 enters the pivot hole 132, the first hook 136 and the second hook 137 return to the original positions so that the link member 145 does not easily fall out of the link member pivoting portion 130.

The protruding member 140 is disposed between the inner surface 123 of the keycap 120 and the link member 145. In the embodiment, the protruding member 140 is disposed on the inner surface 123 of the keycap 120, and may be close to one of the link member pivoting portions 130. Therefore, the link member 145 may be well supported by the link member pivoting portion 130 and the protruding member 140. In the embodiment, the protruding members 140 are disposed beside the link member pivoting portions 130 on the outer side. In other embodiments, the protruding members 140 may be disposed beside each of the link member pivoting portions 130.

As shown in FIG. 6, since the protruding member 140 protrudes from the inner surface 123 of the keycap 120, the link member 145 is supported by the protruding member 140, and does not directly contact a bottom 138 of the link member pivoting portion 130 on a wall surface surrounding the pivot hole 132. In the embodiment, a height difference H1 between a top surface 142 of the protruding member 140 and the bottom 138 of the link member pivoting portion 130 on the wall surface surrounding the pivot hole 132 is between 0.02 mm and 0.04 mm. The disclosure is not limited thereto.

The link member 145 is supported by the protruding member 140 and continues to contact a part of the link member pivoting portion 130 near the opening 135 on the wall surface surrounding the pivot hole 132 in a direction away from the inner surface 123 of the keycap 120 (that is, a part of the first hook portion 136 and the second hook portion 137 away from the inner surface 123 of the keycap 120). Therefore, the link member 145 may be stably supported by the protruding member 140, the first hook portion 136, and the second hook portion 137.

In the conventional technique, there is a tolerance between a size of the link member and the link member pivoting portion, so the link member swings in the link member pivoting portion and generates the noise. In contrast, in the embodiment, the protruding member 140 may compensate or reduce a size difference between the pivot hole 132 of the link member pivoting portion 130 of the keycap 120 and the link member 145, so that the link member 145 may be stably supported. In other words, when the keycap 120 is pressed down, a probability that the link member 145 swings in the pivot hole 132 of the link member pivoting portion 130 of the keycap 120 and generates the noise may be reduced. In addition, the swinging of the link member 145 in the pivot hole 132 caused by a full range of 300 HZ to 2000 HZ audio vibrations when a speaker inside a notebook computer is playing may also be effectively reduced. Therefore, the best audio quality of the notebook computer in a network meeting is improved.

In addition, in the embodiment, the protruding member 140 are integrated with the keycap 120. The protruding member 140 may be integrally formed on the inner surface 123 of the keycap 120 by a way of injection molding when the keycap 120 is made. Alternatively, the protruding member 140 may also be an element independent of the keycap 120 such as a plate, which is disposed on the inner surface 123 through a post-processing method such as pasting. A material of the protruding member 140 may be the same as that of the keycap 120, or an elastic material may be used to made an interference member (for example, foam), or the material may also be a paste-like damping oil.

Figure 7:
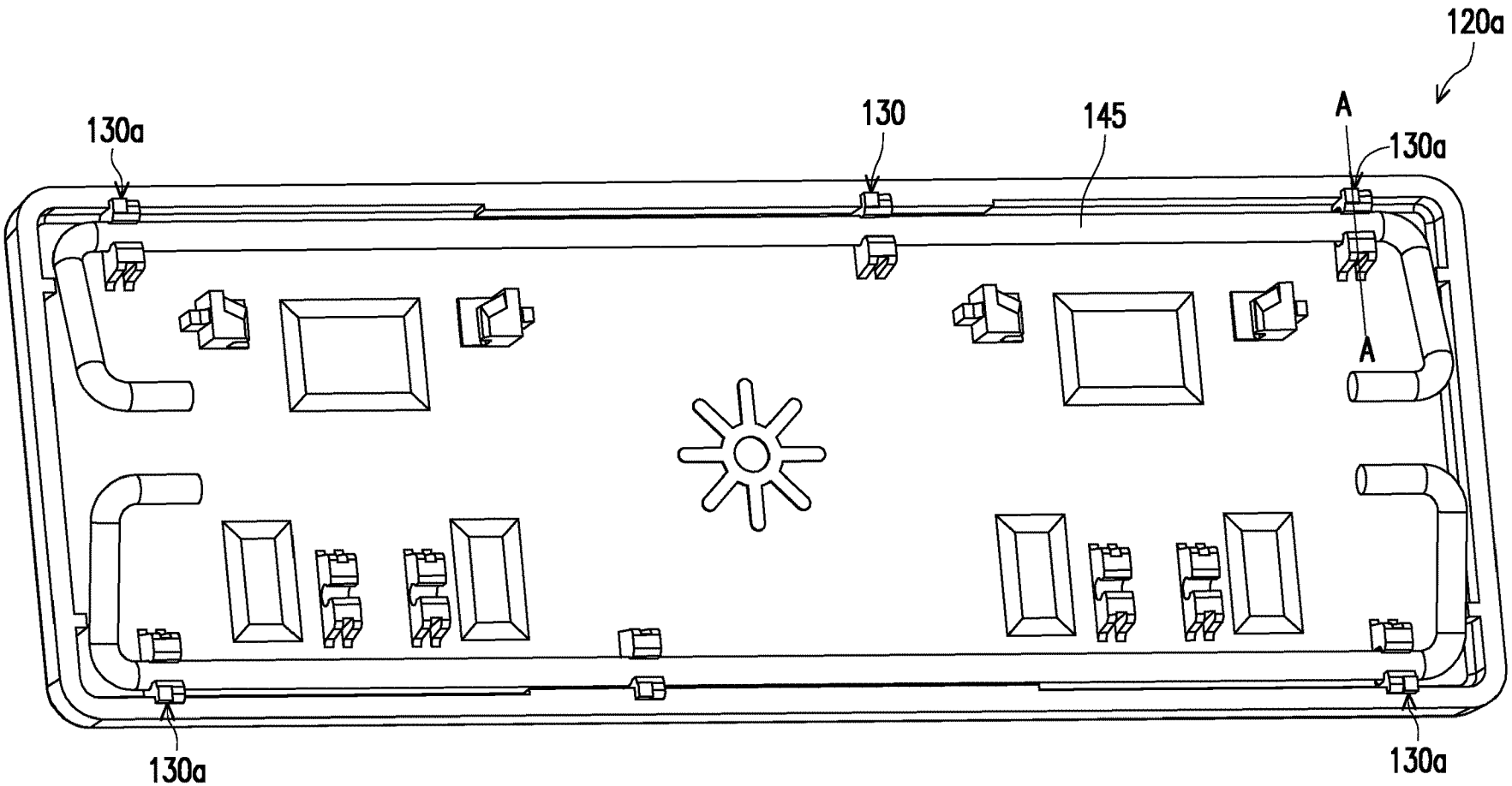
FIG. 7 is a schematic perspective view of a keycap and a link member of a key assembly according to another embodiment of the disclosure.
Figure 8:
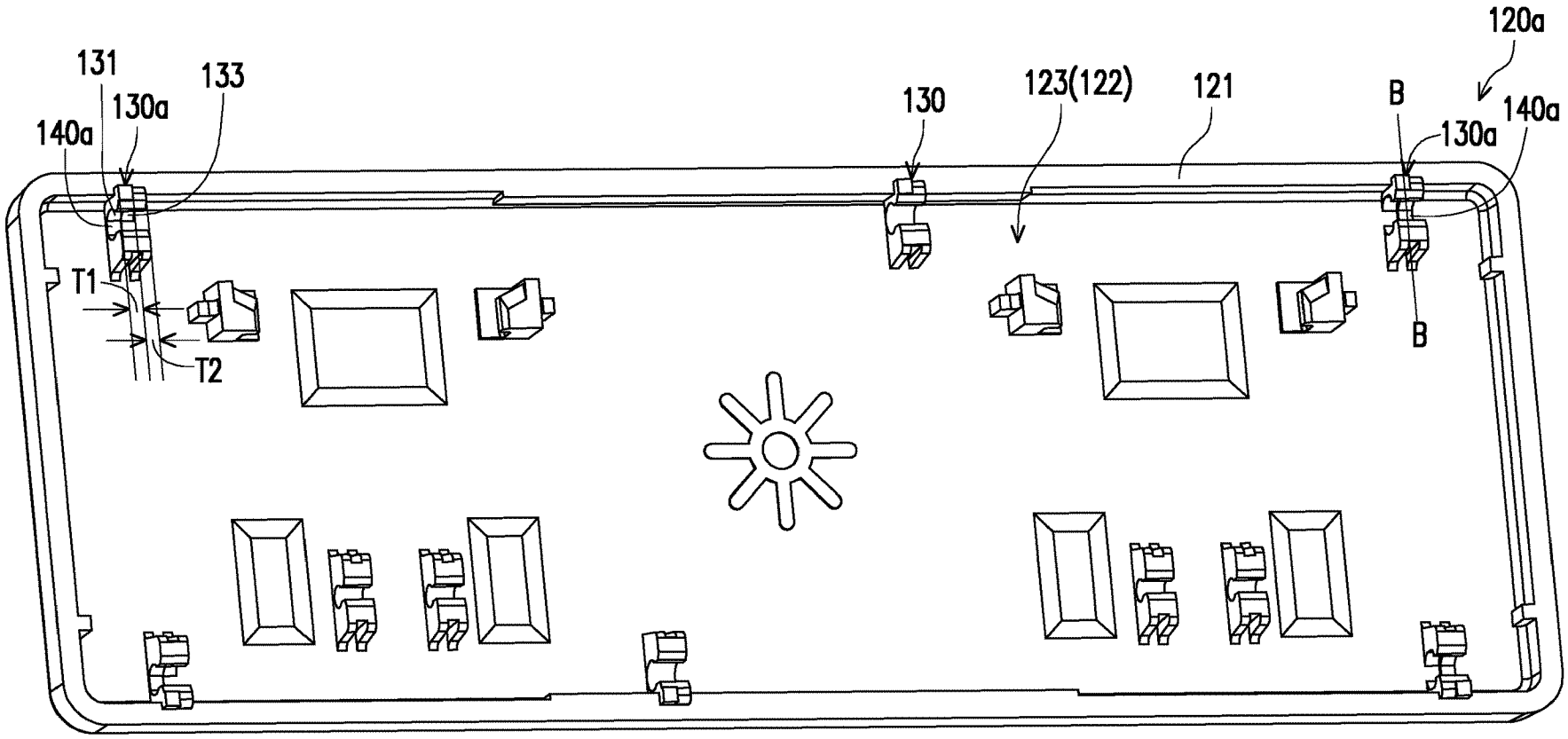
FIG. 8 is a schematic perspective view of the keycap of the key assembly of FIG. 7.
Figure 9:
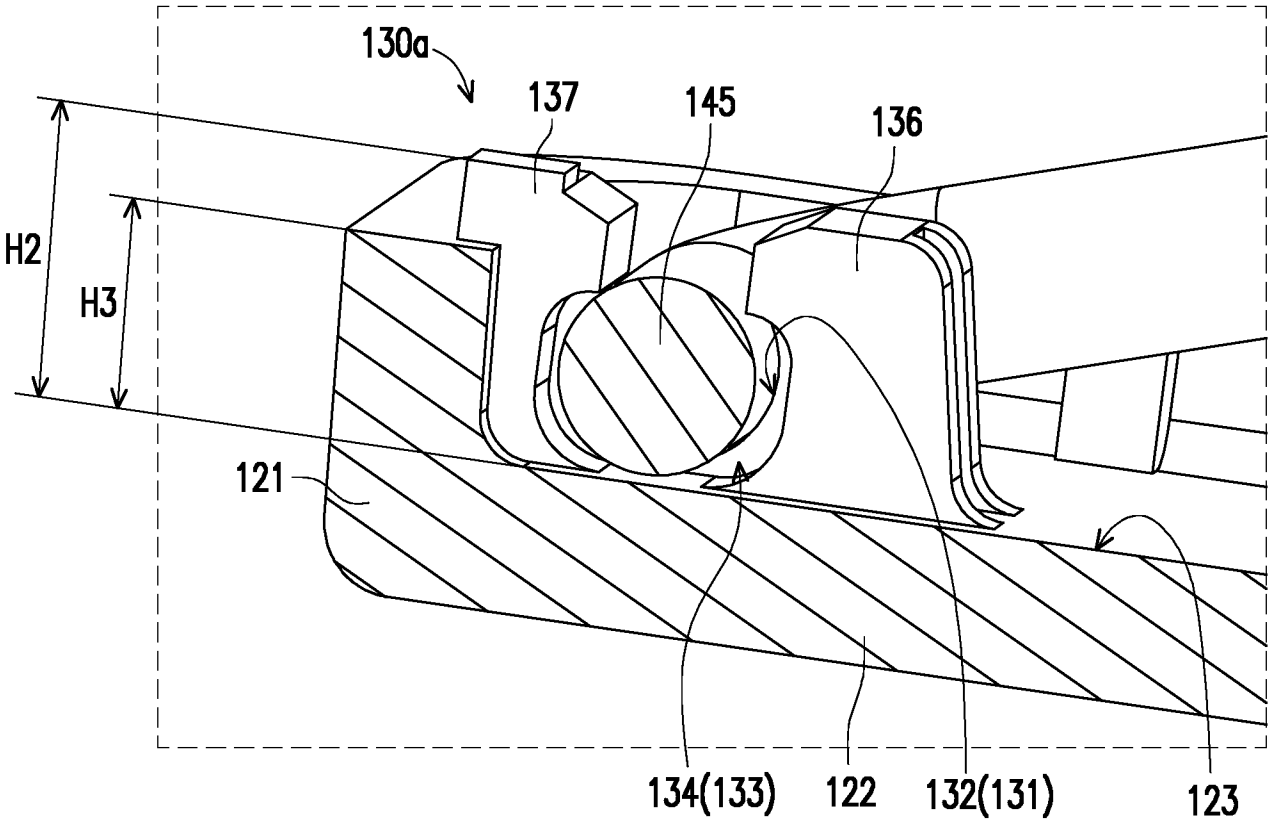
FIG. 9 is a schematic partial cross-sectional view taken along a line A-A of FIG. 7.
Figure 10:
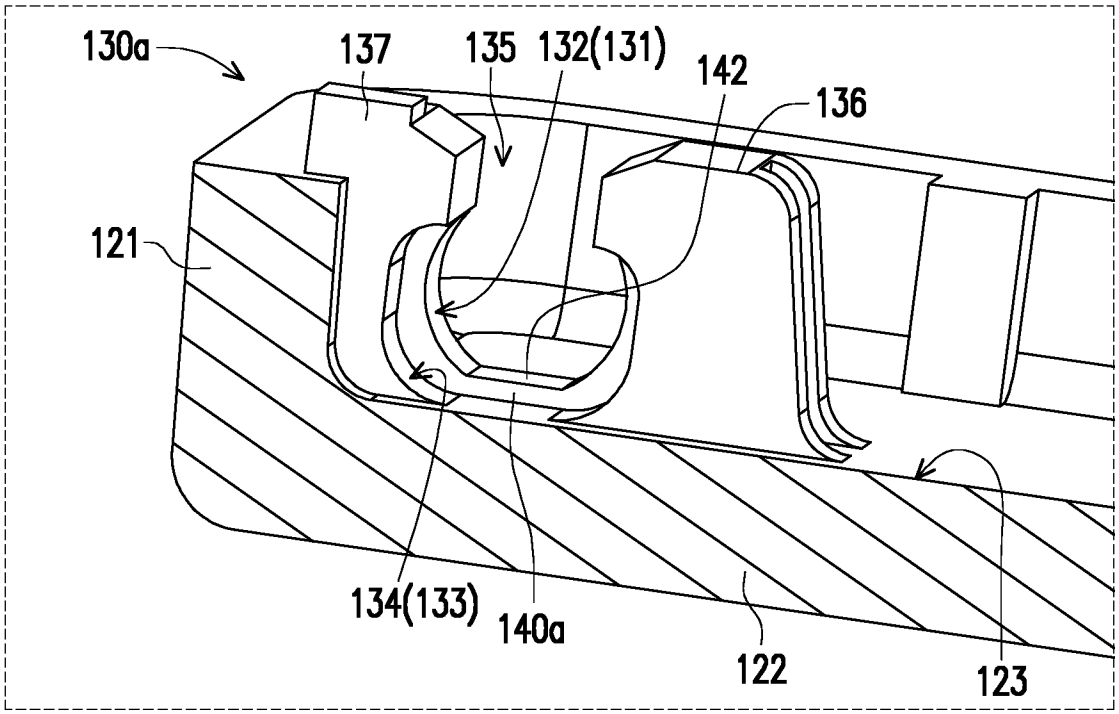
FIG. 10 is a schematic partial cross-sectional view taken along a line B-B of FIG. 8.
Figure 11:
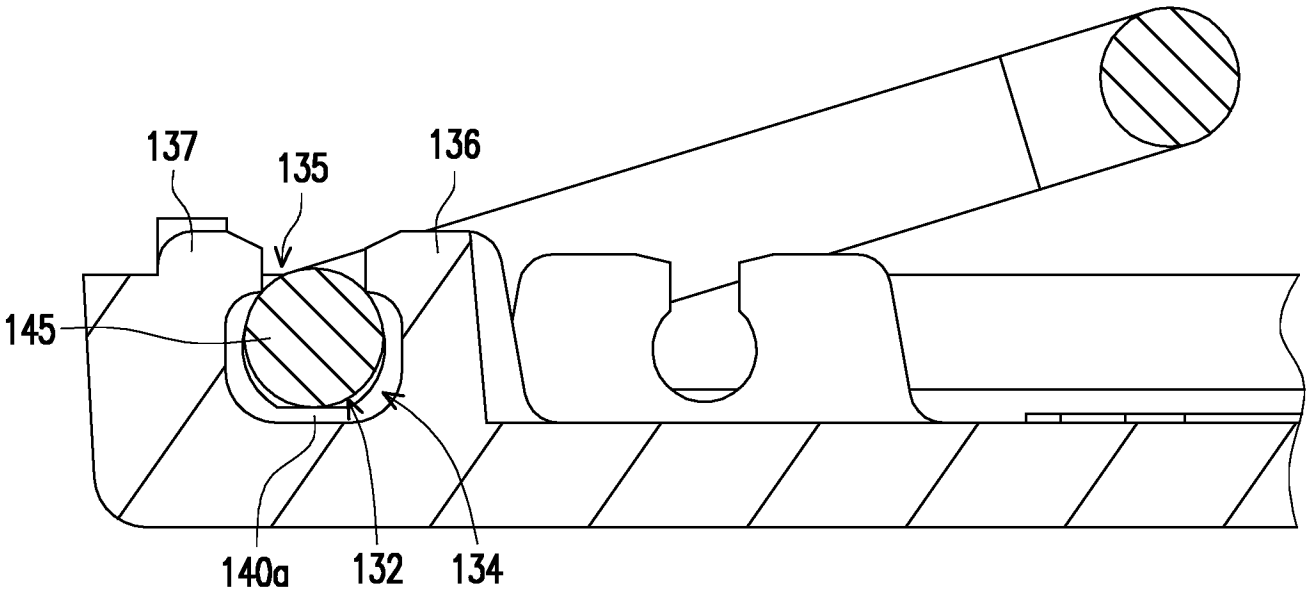
FIG. 11 is a schematic cross-sectional view of FIG. 7.

FIG. 7 is a schematic perspective view of a keycap and a link member of a key assembly according to another embodiment of the disclosure. FIG. 8 is a schematic perspective view of the keycap of the key assembly of FIG. 7. FIG. 9 is a schematic partial cross-sectional view taken along a line A-A of FIG. 7. FIG. 10 is a schematic partial cross-sectional view taken along a line B-B of FIG. 8. FIG. 11 is a schematic cross-sectional view of FIG. 7.

Please refer to FIGS. 7 to 11; a main difference between a keycap 120*a* of the embodiment and the keycap 120 of the previous embodiment is that the protruding member 140 of the previous embodiment is disposed on the inner surface 123 of the keycap 120 outside the link member pivoting portion 130, while in the embodiment, a protruding member 140*a* (FIG. 10) is disposed inside a link member pivoting portion 130*a*. Specifically, the protruding member 140*a* is protrudingly disposed on a wall surface of the link member pivoting portion 130*a* surrounding the pivot hole 132, and the protruding member 140*a* is disposed corresponding to the opening 135.

It is clearly seen from FIG. 11 that such a design may also enable the link member 145 to be supported by the protruding member 140*a* and continuously contact a part of the link member pivoting portion 130*a* near the opening 135 on the wall surface surrounding the pivot hole 132 in a direction away from the inner surface 123 of the keycap 120*a* (that is, a part of the first hook portion 136 and the second hook portion 137 away from the inner surface 123 of the keycap 120*a*). Therefore, the link member 145 may be stably supported by the protruding member 140*a*, the first hook portion 136, and the second hook portion 137.

Therefore, when the keycap 120*a* is pressed down or the low-frequency sound vibrates, a probability that the link member 145 swings in the pivot hole 132 of the link member pivoting portion 130 of the keycap 120*a* and generates the noise may be reduced. Furthermore, in the embodiment, the top surface 142 of the protruding member 140*a* is a flat surface, but the form of the top surface 142 of the protruding member 140*a* is not limited thereto.

In addition, in the embodiment, the link member pivoting portion 130*a* may be selectively divided into a first section 131 and a second section 133 in an axial direction of the pivot hole 132. The pivot hole 132 and the protruding member 140*a* are located in the first section 131, and the second section 133 has a hole 134 corresponding to the pivot hole 132. A size of the hole 134 is larger than a size of the pivot hole 132, and the link member 145 does not contact a wall surface of the link member pivoting portion 130*a* surrounding the hole 134. In other words, the link member 145 contacts only the protruding member 140*a* on the first section 131 so as to reduce a contact area and lower the friction. In the embodiment, a thickness T2 of the second section 133 is smaller than a thickness T1 of the first section 131. Therefore, the friction between the link member 145 and the protruding member 140*a* is smaller, but the relationship of the thickness of the first section 131 and the second section 133 is not limited thereto. In other embodiments, the protruding member may also be formed on the entire bottom 138 of the link member pivoting portion 130*a*.

In addition, as shown in FIG. 9, since the size of the hole 134 is larger than the size of the pivot hole 132, the assembler may easily identify a relative position between the link member 145 and the protruding member 140*a* from the hole 134. In the embodiment, the keycap 120*a* may have the link member pivoting portion 130 and the link member pivoting portion 130*a*. The link member pivoting portions 130*a* having the protruding members 140*a* may be located on two sides, and the link member pivoting portions 130 without the protruding members 140*a* may be located in the center. The assembler may easily identify from the holes 134 which the link member pivoting portions 130*a* having the protrusions 140*a* are.

Furthermore, as shown in FIG. 9, in the embodiment, the first hook portion 136 protrudes from the inner surface 123 of the keycap 120*a*, and the second hook portion 137 extends inward from the side wall 121 of the keycap 120*a* and protrudes from the inner surface 123. A height H2 of the first hook portion 136 and the second hook portion 137 protruding from the inner surface 123 is greater than a height H3 of the side wall 121 protruding from the inner surface 123.

Figure 12:
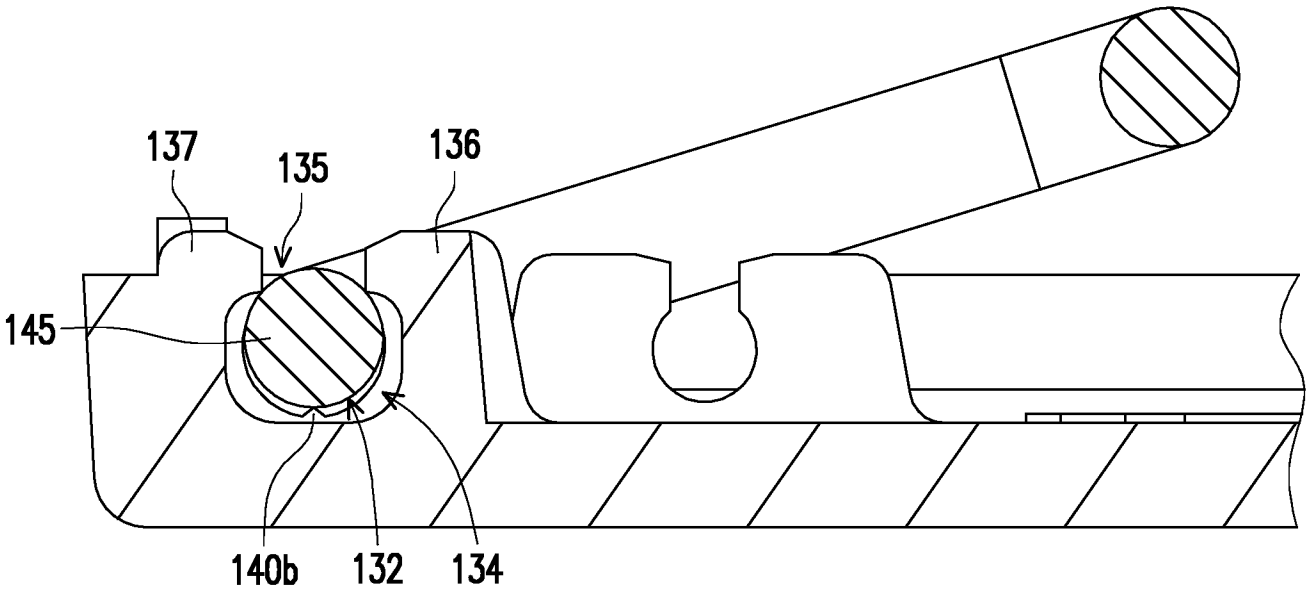
FIG. 12 is a schematic partial cross-sectional view of a keycap and a link member of a key assembly according to another embodiment of the disclosure.

FIG. 12 is a schematic partial cross-sectional view of a keycap and the link member 145 of a key assembly according to another embodiment of the disclosure. Please refer to FIG. 12; a main difference between this embodiment and the embodiment of FIG. 11 is that a top surface of a protruding member 140*b* in the embodiment has a tapered surface and forms a sharp angle. Such a design also enables the link member 145 to be supported by the protruding member 140*b* and continuously contact the part of the first hook portion 136 and the second hook portion 137 away from the inner surface 123 (FIG. 3) of the keycap 120 (FIG. 3). Therefore, the link member 145 may be stably supported.

Figure 13:
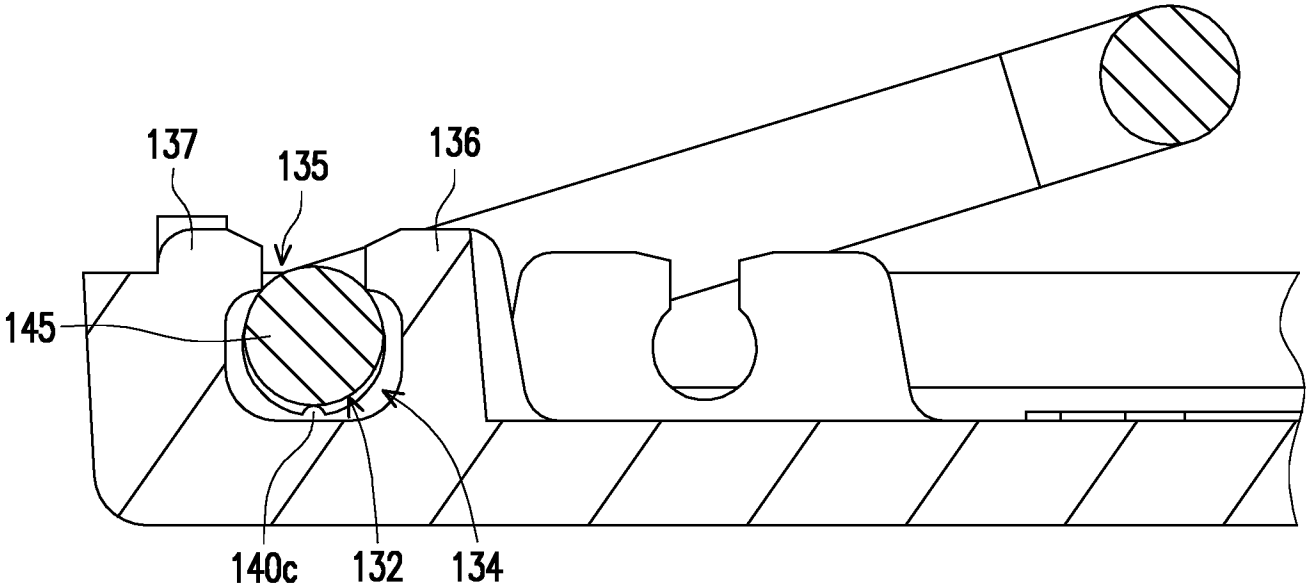
FIG. 13 is a schematic partial cross-sectional view of a keycap and a link member of a key assembly according to another embodiment of the disclosure.

FIG. 13 is a schematic partial cross-sectional view of a keycap and a link member of a key assembly according to another embodiment of the disclosure. Please refer to FIG. 13; a main difference between this embodiment and the embodiment of FIG. 11 is that a top surface of a protruding member 140*c* in the embodiment is a convex arc surface. Such a design also enables the link member 145 to be supported by the protruding member 140*c* and continuously contact the part of the first hook portion 136 and the second hook portion 137 away from the inner surface 123 (FIG. 3) of the keycap 120 (FIG. 3). Therefore, the link member 145 may be stably supported.

The link member of the key assembly of the disclosure is rotatably disposed in the pivot hole of the link member pivoting portion of the keycap, and the protruding member is disposed between the inner surface of the keycap and the link member. Since the protruding member protrudes from the inner surface of the keycap, the link member is supported by the protruding member, and contacts the part of the link member pivoting portion near the opening on the wall surface surrounding the pivot hole. In other words, the protruding member may compensate or reduce the size difference between the pivot hole of the link member pivoting portion of the keycap and the link member, so that the link member may be stably supported. Therefore, when the keycap is pressed down or the low-frequency sound vibrates, the probability that the link member swings in the pivot hole of the link member pivoting portion of the keycap and generates the noise may be reduced.

Finally, it should be noted that the above embodiments are merely used to illustrate technical solutions of the disclosure, and the disclosure is not limited thereto. Although the disclosure has been described in detail with reference to the foregoing embodiments, those of ordinary skill in the art should understand that they can still modify the technical solutions described in the foregoing embodiments, or equivalently replace some or all of the technical features. However, these modifications or replacements do not cause the essence of the corresponding technical solutions to deviate from the scope of the technical solutions of the embodiments of the disclosure.

What is claimed is:

1. A key assembly comprising:

a bottom plate;

a keycap disposed on the bottom plate, the keycap having an inner surface facing the bottom plate, and the keycap comprising a link member pivoting portion protruding from the inner surface, wherein the link member pivoting portion has a pivot hole and an opening communicating with the pivot hole and away from the inner surface, and a size of the opening is smaller than a size of the pivot hole;

an elastic member disposed between the bottom plate and the keycap;

a link member rotatably disposed in the pivot hole; and a protruding member disposed between the inner surface of the keycap and the link member, wherein the link member is supported by the protruding member, and the link member contacts a part of the link member pivoting portion near the opening on a wall surface surrounding the pivot hole;

wherein the protruding member is protrudingly disposed on the wall surface of the link member pivoting portion surrounding the pivot hole, and the protruding member corresponds to the opening;

wherein the link member pivoting portion is divided into a first section and a second section in an axial direction of the pivot hole, the pivot hole and the protruding member are located in the first section, the second section has a hole corresponding to the pivot hole, a size of the hole is larger than the size of the pivot hole, and the link member does not contact a wall surface of the link member pivoting portion surrounding the hole.

2. The key assembly according to claim 1, wherein a height difference between a top surface of the protruding member and a bottom of the link member pivoting portion on the wall surface surrounding the pivot hole is between 0.02 mm and 0.04 mm.

3. The key assembly according to claim 1, wherein a top surface of the protruding member is a flat surface, an arc surface, or a tapered surface.

4. The key assembly according to claim 1, wherein a thickness of the second section is smaller than a thickness of the first section.

5. The key assembly according to claim 1, wherein the keycap includes a plate body portion and a side wall protruding from a periphery of the plate body portion, the plate body portion has an inner surface, the link member pivoting portion includes a first hook portion and a second hook portion, the first hook portion and the second hook portion jointly form the pivot hole and the opening, the first hook portion protrudes from the inner surface of the keycap, the second hook portion extends inward from the side wall of the keycap and protrudes from the inner surface, and a height of the first hook portion and the second hook portion protruding from the inner surface is greater than a height of the side wall protruding from the inner surface.

6. A keyboard module comprising a plurality of key assemblies according to claim 1.

7. The keyboard module according to claim 6, wherein a height difference between a top surface of the protruding member and a bottom of the link member pivoting portion on the wall surface surrounding the pivot hole is between 0.02 mm and 0.04 mm.

8. The keyboard module according to claim 6, wherein a top surface of the protruding member is a flat surface, an arc surface, or a tapered surface.

9. The keyboard module according to claim 6, wherein a thickness of the second section is smaller than a thickness of the first section.

10. The keyboard module according to claim 6, wherein the keycap includes a plate body portion and a side wall protruding from a periphery of the plate body portion, the plate body portion has an inner surface, the link member pivoting portion includes a first hook portion and a second hook portion, the first hook portion and the second hook portion jointly form the pivot hole and the opening, the first hook portion protrudes from the inner surface of the keycap, the second hook portion extends inward from the side wall of the keycap and protrudes from the inner surface, and a height of the first hook portion and the second hook portion protruding from the inner surface is greater than a height of the side wall protruding from the inner surface.

* * * * *